US006609627B1

(12) United States Patent
Clarke

(10) Patent No.: US 6,609,627 B1
(45) Date of Patent: Aug. 26, 2003

(54) THERMALLY INSULATED MICROWAVE COOKING CONTAINER

(76) Inventor: Kevin William Joseph Clarke, Yaffles, Clewers Lane, Waltham Chase, Southampton Hampshire, SO32 2LP (GB)

( * ) Notice: Subject to any disclaimer, the term of this patent is extended or adjusted under 35 U.S.C. 154(b) by 0 days.

(21) Appl. No.: 09/807,455

(22) PCT Filed: Oct. 7, 1999

(86) PCT No.: PCT/GB99/03338

§ 371 (c)(1),
(2), (4) Date: Apr. 12, 2001

(87) PCT Pub. No.: WO00/21849

PCT Pub. Date: Apr. 20, 2000

Related U.S. Application Data

(60) Provisional application No. 60/110,660, filed on Dec. 2, 1998.

(30) Foreign Application Priority Data

Oct. 12, 1998 (GB) ..... 9822101
Jan. 20, 1999 (GB) ..... 9901176

(51) Int. Cl.[7] ..... H05B 6/80

(52) U.S. Cl. ..... 220/592.2; 220/523; 220/641; 220/921; 219/734

(58) Field of Search ..... 220/523, 592.2, 220/592.27, 592.28, 641, 657, 659, 918, 921; 219/734, DIG. 14

(56) References Cited

U.S. PATENT DOCUMENTS 2,725,733 A * 12/1955 Davis ..... 215/12.1
3,025,947 A * 3/1962 Hammer ..... 206/545
4,081,646 A * 3/1978 Goltsos ..... 219/729
5,300,748 A 4/1994 Colombo
5,318,810 A 6/1994 Nissel
5,579,946 A * 12/1996 Rowan et al. ..... 220/592.27

FOREIGN PATENT DOCUMENTS

| | | |
|---|---|---|
| EP | 0242701 | 10/1987 |
| EP | 0509664 | 10/1992 |
| GB | 2194515 | 3/1988 |
| GB | 2201400 | 9/1988 |

* cited by examiner

*Primary Examiner*—Joseph M. Moy
(74) *Attorney, Agent, or Firm*—Ware, Fressola, Van der Sluys & Adolphson

(57) ABSTRACT

A container comprising an inner thermoformed vessel (1) and an outer thermoformed vessel (2), arranged the one within the other. The side walls (9) of the outer forming (2) surround the side walls (10) of the inner forming (1). The outer side walls has inwardly projecting ribs (11), which abut the inner side walls (10) to maintain an air gap (12) between the formings, with the formings being centered with respect to each other. The air gap is present between the bases (13, 14) of the inner and outer formings, with the outer forming being provided with ribs in its base also. In use food in the container can be heated in a micro-wave oven until hot. The air gap separates a handler's fingers from direct thermal contact with the hot food so that the container remains comfortable to handle.

32 Claims, 3 Drawing Sheets

THERMALLY INSULATED MICROWAVE COOKING CONTAINER

This application claims the benefit of Provisional Application Ser. No. 60/110,660 filed Dec. 2, 1998.

TECHNICAL FIELD

The present invention relates to a container, particularly, though not exclusively, a disposable container in which food can be heated.

BACKGROUND OF THE INVENTION

It is known for food to be heated in plastics material containers in micro-wave ovens and indeed conventional ovens, provided the melting point of the material is sufficiently high.

Polypropylene is generally an economic material to make containers from. However, a simple container suffers from the inconvenience that when containing hot material, it conducts the heat to fingers holding it.

SUMMARY OF THE INVENTION

The object of the present invention is to provide a container having a degree of thermal insulation in its side walls.

According to the present invention there is provided a food packaging container comprising:

a first plastics material vessel;

a second vessel arranged with its side wall(s) surrounding the side wall(s) of the first vessel;

projecting ribs on the sides and/or bases of either the first vessel or the second vessel or both vessels, the ribs being outwardly projecting on the first vessel and/or inwardly projecting on the second vessel, whereby heat from the contents of the container, i.e. within the inner, first vessel, does not directly heat the entire wall(s) of the outer, second vessel.

Preferably the two vessels are secured together. While this securement can be by inter-engagement of the rims of the vessels, it is preferably by bonding connection of the vessels, conveniently at their bases.

The bonding can be by means of adhesive. Alternatively, it can be by welding. Preferably the welding is at the ribs in the base of either vessel.

Conveniently the first vessel may be provided with an integral lid connected to a rims of the vessel by a living hinge. The lid would be shaped at its edge to co-operate with the rim of the vessel so that the lid remains closed. Alternatively a lid may be provided on the second vessel.

Usually both vessels will be manufactured from polypropylene material. While both forming may be of a translucent grade or a coloured grade, typically the inner one will be of a translucent grade, while the outer will be of a coloured grade.

BRIEF DESCRIPTION OF THE DRAWINGS

To help understanding of the invention, two specific embodiments thereof will now be described, by way of example and with reference to the accompanying drawings, in which.

BEST MODE FOR CARRYING OUT THE INVENTION

Figure 1:
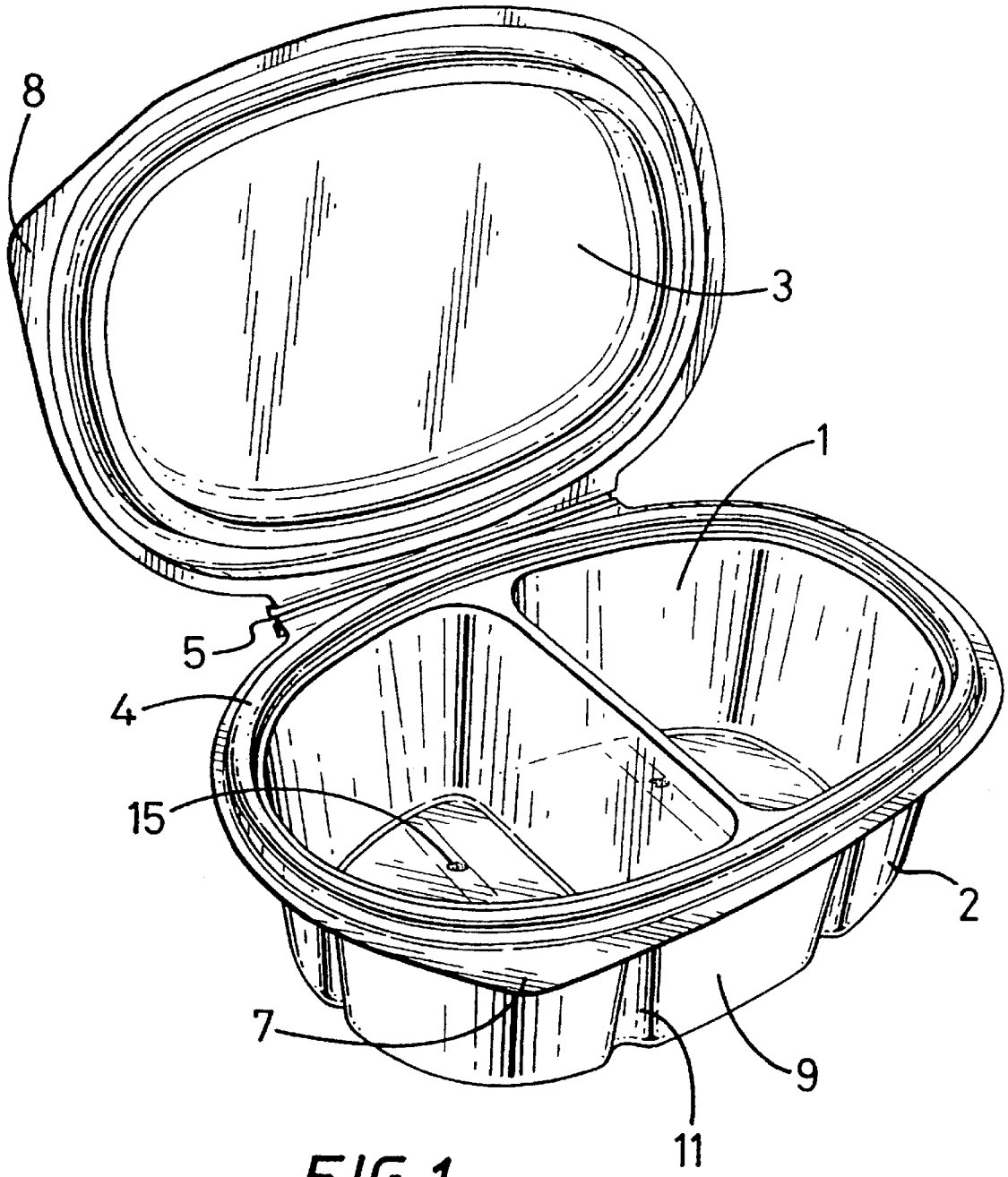
FIG. 1 is a perspective view of a container of the invention when open.
Figure 2:
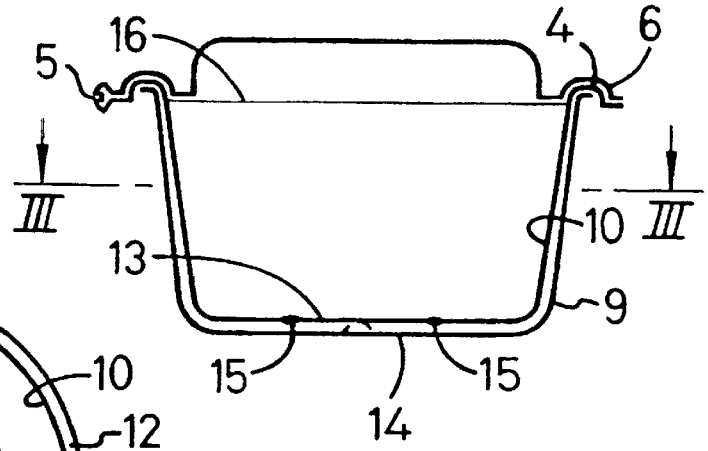
FIG. 2 is a cross-sectional end view of the container when closed on the line II—II in FIG. 3.
Figure 3:
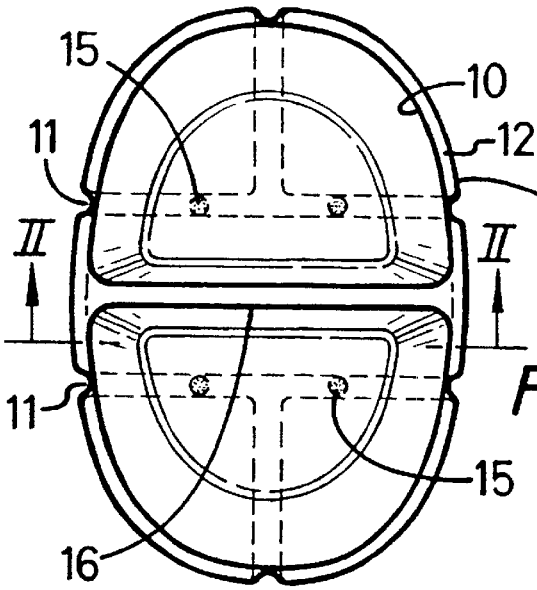
FIG. 3 is a cross-sectional plan view of the container on the line III—III in FIG. 2.

Referring to FIGS. 1 to 3 of the drawings, the container thereshown is a two compartment container for take-away food to be heated in a microwave oven.

The container has an inner thermoformed vessel 1 and an outer thermoformed vessel 2, arranged the one within the other. Both formings 1, 2 are of polypropylene material, the inner one being of a translucent grade and the outer of a coloured grade.

The inner forming has an integral lid 3 connected to a rim 4 of the forming by a living hinge 5. The lid is conventionally shaped at its edge 6 to co-operate with the rim 4 so that the lid remains closed. The rim and lid are provided with tabs 7, 8 to be grasped for opening of the lid. This lid is optional and on embodiments not shown may not be present.

Side walls 9 of the outer forming surround the side walls 10 of the inner forming. The outer side walls have inwardly extending ribs 11, which abut the inner side walls to maintain an air gap 12 between the formings with the formings being centred with respect to each other. The air gap is present between the inner and outer bases 13, 14, with the ribs extending across the outer base.

The ribs 11 may alternatively or in addition extend outwardly from side wall 10 of the inner forming 1.

At four spaced positions 15 on the ribs in the outer base 14, the inner base 13 is ultrasonically welded to the outer base.

In use, the food in the container can be heated in a micro-wave oven. When the container is subsequently handled the air gap separates the user's fingers from direct conductive thermal contact with the hot food so that the container remains comfortable to handle.

Figure 4:
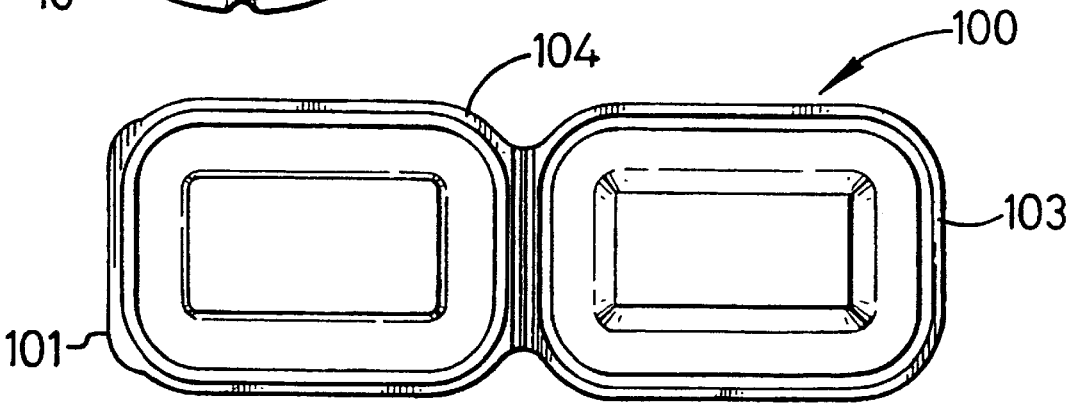
FIG. 4 is a top view of another container according to the invention.
Figure 5:
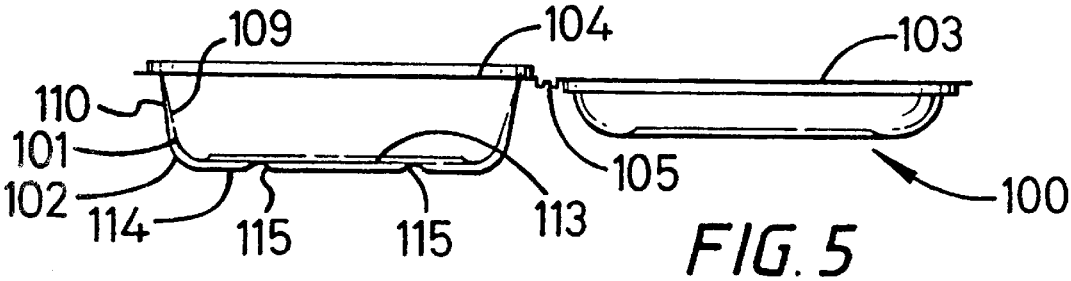
FIG. 5 is a side view of the container of FIG. 4.

Referring now to FIGS. 4 and 5, the container 100 thereshown is also a container for take-away food to be heated in a micro-wave oven. This container has an inner thermoformed vessel 101 and an outer thermoformed vessel 102 arranged one within the other. Both formings 101, 102 are also made from polypropylene material. Again the inner vessel has an integral lid 103 connected to a rim 104 of the forming by a living hinge 105. This lid is optional and not necessary to the functioning of the insulation of the vessel.

The base 114 of the outer forming 102 has inwardly extending ribs 115 which abut the base 113 of the inner forming 101 maintaining an air gap between the formings. At at least four positions (not shown) on the ribs, the inner forming 101 is ultrasonically welded to the outer forming 102. The side walls 109, 110 of the inner and outer formings are angled such that they converge at their rims 104 maintaining an air gap between the two formings. As above after heating of food placed in this container, the outer surface of the vessel is cool to the touch as it is not in direct conductive thermal contact with the hot food.

Figure 6:
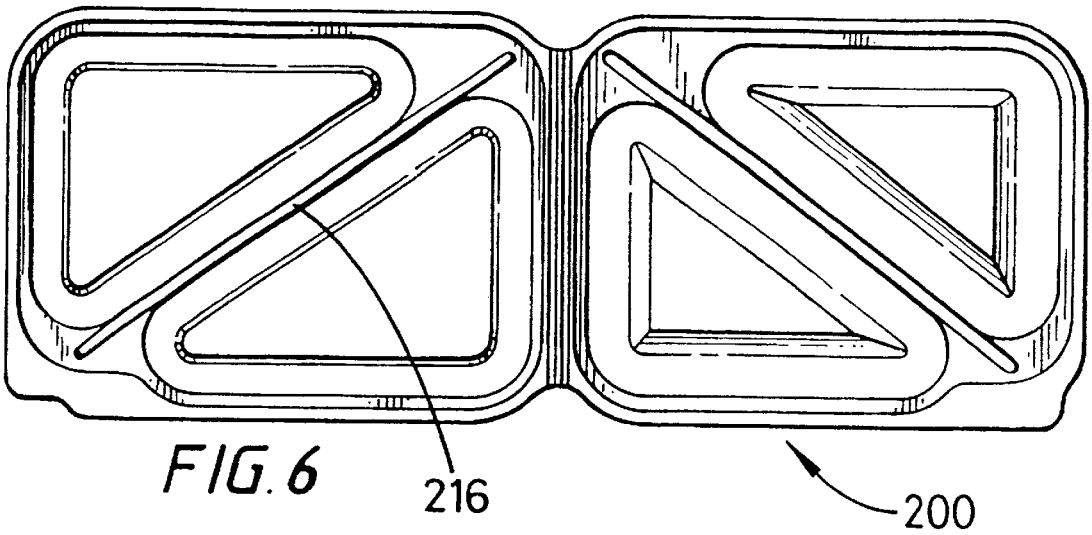
FIG. 6 is a top view of a variant of the container of FIG. 4.
Figure 7:
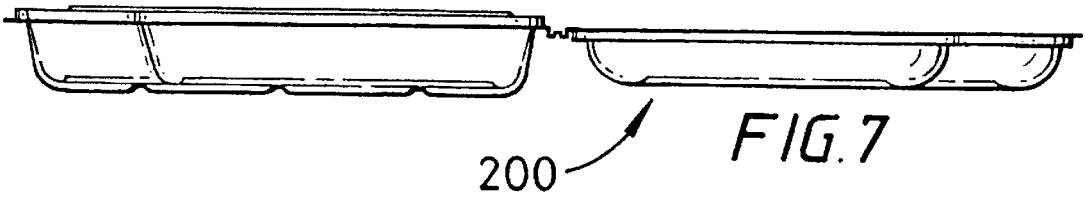
FIG. 7 is a side view of the container of FIG. 6.
Figure 8:
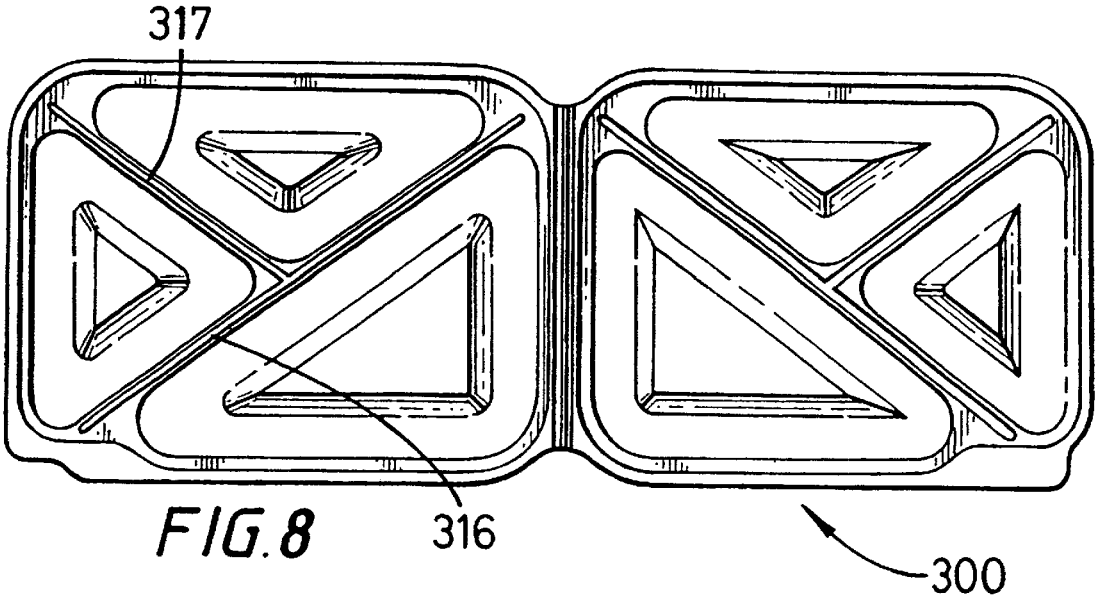
FIG. 8 is a top view of a second variant of the container of FIG. 4.
Figure 9:
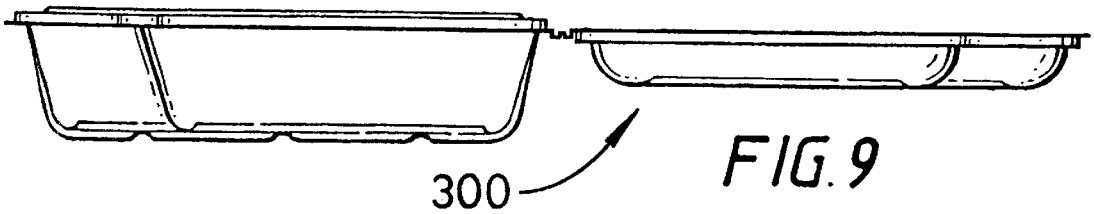
FIG. 9 is a side view of the container of FIG. 8.

Turning now to FIGS. 6 and 7, the container 200 thereshown is similar to the one shown in FIGS. 4 and 5, except that the inner forming 201 includes a divider 216. Similarly with the container 300 shown in FIGS. 8 and 9, the container thereshown includes two dividers 316, 317 to allow three separate foods to be heated in the same container. Again the lids in the container are not essential to the functioning of the invention.

The invention is not intended to be restricted to the details of the above described embodiment. For instance, the container could be a cup or bowl. Not only can the translucent and coloured materials of the formings be changed, but also other plastics materials can be used.

What is claimed is:

1. A plastics material food packaging container comprising:

a first plastics material vessel;

a second vessel arranged with its side wall(s) surrounding the side wall(s) of the first vessel;

projecting ribs on the first vessel projecting outwardly, whereby heat from contents of the container, i.e. within the inner, first vessel, does not directly heat the entire wall(s) of the outer, second vessel; characterised in that rims on the first and second vessels, the rims having complementary formations for inter-engagement thereof; and the vessels being secured together by ultrasonic welding.

2. A container as claimed in claim 1, wherein both vessels are thermoformings.

3. A container as claimed in claim 1, wherein the first vessel is provided with an integral lid connected to the rim of the vessel by a living hinge.

4. A container as claimed in claim 3, wherein the lid is shaped at its edge to cooperate with the rim of the vessel so that the lid remains closed.

5. A container as claimed in claim 1, wherein a lid is provided on the second vessel.

6. A container as claimed in claim 1, wherein the vessels are of polypropylene material, the first vessel of a translucent grade and the second vessel of a coloured grade.

7. A container as claimed in claim 1, wherein the side walls of the first and second vessels are angled such that they converge at their rims, maintaining an air gap between the two vessels.

8. A container as claimed in claim 1, wherein the first vessel includes one or more dividers such that more than one foodstuff can be heated in the same container without contamination.

9. A container as claimed in claim 8, wherein the divider (s) and lid have complementary formations for inter-engagement.

10. A container as claimed in claim 2, wherein the first vessel is provided with an integral lid connected to the rim of the vessel by a living hinge.

11. A container as claimed in claim 2, wherein a lid is provided on the second vessel.

12. A container as claimed in claim 5, wherein the vessels are of polypropylene material, the first vessel of a translucent grade and the second vessel of a coloured grade.

13. A container as claimed in claim 6, wherein the side walls of the first and second vessels are angled such that they converge at their rims, maintaining an air gap between the two vessels.

14. A container as claimed in claim 7, wherein the first vessel includes one or more dividers such that more than one foodstuff can be heated in the same container without contamination.

15. A plastics material food packaging container comprising:

a first plastics material vessel;

a second vessel arranged with its side wall(s) surrounding the side wall(s) of the first vessel;

projecting ribs on the second vessel projecting inwardly, whereby heat from contents of the container, i.e. within the inner, first vessel, does not directly heat the entire wall(s) of the outer, second vessel; characterised in that rims on the first and second vessels, the rims having complementary formations for inter-engagement thereof; and the vessels being secured together by ultrasonic welding.

16. A container as claimed in claim 15, wherein both vessels are thermoformings.

17. A container as claimed in claim 15, wherein the first vessel is provided with an integral lid connected to the rim of the vessel by a living hinge.

18. A container as claimed in claim 17, wherein the lid is shaped at its edge to cooperate with the rim of the vessel so that the lid remains closed.

19. A container as claimed in claim 15, wherein a lid is provided on the second vessel.

20. A container as claimed in claim 15, wherein the vessels are of polypropylene material, the first vessel of a translucent grade and the second vessel of a coloured grade.

21. A container as claimed in claim 15, wherein the side walls of the first and second vessels are angled such that they converge at their rims, maintaining an air gap between the two vessels.

22. A container as claimed in claim 15, wherein the first vessel includes one or more dividers such that more than one foodstuff can be heated in the same container without contamination.

23. A container as claimed in claim 22, wherein the divider(s) and lid have complementary formations for inter-engagement.

24. A plastics material food packaging container comprising:

a first plastics material vessel;

a second vessel arranged with its side wall(s) surrounding the side wall(s) of the first vessel;

projecting ribs on the first vessel projecting outwardly and projecting ribs on the second vessel projecting inwardly, whereby heat from contents of the container, i.e. within the inner, first vessel, does not directly heat the entire wall(s) of the outer, second vessel; characterised in that rims on the first and second vessels, the rims having complementary formations for inter-engagement thereof; and the vessels being secured together by ultrasonic welding.

25. A container as claimed in claim 24, wherein both vessels are thermoformings.

26. A container as claimed in claim 24, wherein the first vessel is provided with an integral lid connected to the rim of the vessel by a living hinge.

27. A container as claimed in claim 26, wherein the lid is shaped at its edge to cooperate with the rim of the vessel so that the lid remains closed.

28. A container as claimed in claim 24, wherein a lid is provided on the second vessel.

29. A container as claimed in claim 24, wherein the vessels are of polypropylene material, the first vessel of a translucent grade and the second vessel of a coloured grade.

30. A container as claimed in claim 24, wherein the side walls of the first and second vessels are angled such that they converge at their rims, maintaining an air gap between the two vessels.

31. A container as claimed in claim 24, wherein the first vessel includes one or more dividers such that more than one foodstuff can be heated in the same container without contamination.

32. A container as claimed in claim 31, wherein the divider(s) and lid have complementary formations for inter-engagement.

* * * * *

UNITED STATES PATENT AND TRADEMARK OFFICE

CERTIFICATE OF CORRECTION

PATENT NO. : 6,609,627 B1
DATED : August 26, 2003
INVENTOR(S) : Clarke

It is certified that error appears in the above-identified patent and that said Letters Patent is hereby corrected as shown below:

Column 3,
Line 19, insert -- Having described the invention, what is claimed is -- instead of "What is claimed is"

Signed and Sealed this

Ninth Day of December, 2003

JAMES E. ROGAN
*Director of the United States Patent and Trademark Office*